United States Patent [19]

German et al.

[11] Patent Number: 4,612,048

[45] Date of Patent: Sep. 16, 1986

[54] DIMENSIONALLY STABLE POWDER METAL COMPOSITIONS

[75] Inventors: Randall M. German, Latham, N.Y.; Chaman Lall, Claymont, Del.; Deepak S. Madan, Troy, N.Y.

[73] Assignee: E. I. Du Pont de Nemours and Company, Wilmington, Del.

[21] Appl. No.: 754,741

[22] Filed: Jul. 15, 1985

[51] Int. Cl.[4] ..... C22C 29/00

[52] U.S. Cl. ..... 75/246; 75/123 D; 75/123 J; 75/123 K; 75/132; 75/255; 419/39; 419/58; 419/60; 419/23; 420/119

[58] Field of Search ..... 75/246, 123 B, 123 D, 75/123 J, 123 K, 132, 255; 419/39, 58, 60, 23

[56] References Cited

U.S. PATENT DOCUMENTS 3,977,838 8/1976 Hashimoto et al. ..... 75/246

4,526,617 7/1985 Hiraoka et al. ..... 75/246

*Primary Examiner*—Stephen J. Lechert, Jr.

[57] ABSTRACT

Powder metal compositions of nickel, molybdenum, boron, carbon, phosphorus and iron which exhibit low shrinkage on sintering.

7 Claims, No Drawings

DIMENSIONALLY STABLE POWDER METAL COMPOSITIONS

BACKGROUND OF THE INVENTION

Powder metal compositions are widely used for the fabrication of metal parts by compacting the powder into the desired configuration followed by sintering. Typically, in the sintering operation, the molded part undergoes irregular shrinkage, which necessitates further refinishing, sizing, restriking or repressing of the article to obtain the precise dimensions required.

SUMMARY OF THE INVENTION

The instant invention provides an improved powder metal composition and a process for forming this composition which results in molded alloys which undergo exceptionally low dimensional change in sintering.

Specifically, the instant invention provides a powder metal composition consisting essentially of about from 1 to 4 wt % nickel, about from 2 to 4 wt % molybdenum, about from 0.1 to 0.3 wt % boron, about from 0.1% to 0.2 wt % carbon, about from 0.1 to 0.2 wt % phosphorus and the balance iron.

The invention also provides a process for forming the above compositions by blending the powder components, pressing the resulting blend into the desired figuration at a pressure of about from 400 to 850 MPa, and sintering the resulting article in a partial vacuum, dry hydrogen or an inert atmosphere at a temperature of about from 1160° to 1200° C. for a period of about from 30 to 90 minutes.

DETAILED DESCRIPTION OF THE INVENTION

The present invention is based on the discovery that a powder metal composition of the indicated six components in the required percentages provides a composition which, when sintered, exhibits the good tensile and mechanical properties expected of a formed powder metal shape, but, at the same time is characterized by little or no shrinkage during the sintering step. Accordingly, the resulting articles do not require the supplemental treatment that is typically needed for powder metal products after sintering, such as sizing, restriking, coining or repressing.

The powder blends of the present invention can be prepared by techniques usually employed for similar compositions, for example, tumble blending of fine powders of the components. The components are added in the weight percentages indicated above. However, the total concentration of boron, phosphorous and carbon should not exceed about 0.5%. Preferably, the composition comprises about 0.1% boron, 0.1% carbon, 0.1% phosphorous, 2% nickel, 3% molybdenum, and the balance iron. The powders, generally having a particle size of about from 1 to 200 microns, can be either elemental or pre-alloyed powders. The required concentrations of phosphorus, for example, can be added as elemental phosphorus. Preferably, however, the phosphorus is added as a component of iron phosphide. The powders can be used directly as they are supplied through normal commercial channels.

After intimate blending of the components, the powder blend is pressed to a green compact, using a pressure of about from 400 to 850 MPa. Pressures below about 400 MPa (30 tons per square inch) can result in undesirable shrinkage during sintering, while pressures higher than about 850 MPa (about 60 tons per square inch) are generally not practical, because of the greater possibility of tool breakage.

After pressing to the desired configuration, the formed article is sintered at temperatures of about from 1160° to 1200° C. for a period of about from 30 to 90 minutes. A sintering temperature of about 1175° C. has been found to be particularly satisfactory. The sintering should be carried out, for optimum results, in a partial or substantial vacuum, for example, of about from 100 to 500 microns of mercury pressure, or in an atmosphere such as dry hydrogen. An atmosphere of any inert gas can also be used. A pure or mixed dissociated ammonia atmosphere, often used in sintering operations, is generally not suitable for the present compositions.

For wear applications, the resulting alloy can be heat treated according to usual techniques for further improvement in hardness and strength. For example, the sintered articles can be heat treated at temperatures of about from 800° to 1000° C., and preferably about 900° C., for a period of about from 1 to 2 hours, followed by tempering at 205° C. for 30 minutes and 177° C. for 30 minutes.

In addition to the metal components of the present powder metal blends, the compositions can contain minor percentages, for example, up to about 1% by weight, of conventional lubricants, such as Acrawax C, commercially available from GLYCO Corporation.

The compositions of the present invention, in their sintered condition, exhibit the tensile properties, hardness and impact strength expected of good quality powder metal parts. Specifically, molded compositions exhibit an ultimate tensile strength of about from 475 to 700 MPa (70,000 to 100,000 psi) and an elongation of about 3–5%. Good yield strength, impact strength, hardness, density and Young's modulus are also observed. In addition, however, the present compositions exhibit a surprisingly low volume change during sintering. Shrinkage or expansion of less than about 0.001 inch/inch is typically observed in the compositions of the invention when the preferred sintering conditions are used. These characteristics make the present compositions particularly useful in applications which require tight dimensional control, such as precision gears.

The present invention is further illustrated by the following specific examples, in which parts and percentages are by weight, unless otherwise indicated.

EXAMPLES 1 AND 2

In Examples 1 and 2, a powder metal composition was prepared by blending 2% nickel, 3% molybdenum, 0.1% carbon, 0.1% boron, 0.1% phosphorus and the balance iron. In Example 1, phosphorous was added as $Fe_3P$, while elemental phosphorous was used in Example 2. After tumble blending, the alloys were pressed at 50 tons per square inch and sintered for 1 hour in vacuum (100–200 microns) at the temperatures indicated in Table 1. The resulting sintered articles were evaluated for shrinkage, ultimate tensile strength, yield, elongation, hardness, and impact strength, and the results are reported in Table 1. Higher temperatures were found to lead to higher strengths but poorer dimensional stability.

An alloy of Example 1 was pressed at about 700 MPa and sintered at 1190° C. for 60 minutes and then heat-treated, drawn and redrawn. Tensile and impact bars were tested from this material and the results summarized in Table 2.

EXAMPLES 3 AND 4

Examples 3 and 4 were prepared having the same composition and from the same components as in Examples 1 and 2, respectively, but compacted using different compaction pressures and sintered for different periods, in a vacuum (100 microns). The resulting sintered alloys were evaluated as before, and the results are summarized in Table 3.

EXAMPLE 5

An alloy was prepared from a powder mixture containing 2% nickel, 3% molybdenum, 0.1% boron, 0.1% carbon, 0.1% phosphorous and the balance iron. The composition was formed using a variety of compacting pressures and sintered in a vacuum furnace (at 500 microns) for 30 to 90 minutes at temperatures of from 2100° to 2200° F. The resulting sintered articles were evaluated and the results summarized in Table 4.

EXAMPLES 6–9

Powder metal compositions were prepared from iron, phosphorus, molybdenum, carbon, nickel and boron, pressed at 620 MPa (45 tons per square inch), with die wall lubrication, and sintered in hydrogen at 1200° C. for 60 minutes. The resulting sintered articles were evaluated and the results summarized in Table 5.

TABLE 1

| Example | T (°F.) | Green Density (g/cc) | Sintered Density (g/cc) | Shrinkage (in/in) | UTS (ksi) | Yield (ksi) | Elong. (%) | Hardness ($R_B$) | Impact (ft-lbs) |
|---|---|---|---|---|---|---|---|---|---|
| 1A | 2200 | 7.2 | 7.03 | −.0072<br>−.0063 | 93.0 | 77.0 | 4 | 88/92 | 16 |
| 1B | 2250 | 7.2 | 6.97 | −.0085<br>.0090 | 101.2 | 76.5 | 4 | 94/96 | 11 |
| 1C | 2300 | 7.2 | 6.91 | −.0102<br>−.0102 | 107.9 | 80.6 | 3 | 95/98 | 10 |
| 2A | 2150 | 7.2 | 7.15 | −.0006<br>−.0014 | 84.6 | 59.2 | 5 | 85/84 | 27 |
| 2B | 2200 | 7.2 | 7.01 | −.0057<br>−.0071 | 91.4 | 64.2 | 4 | 89/89 | 17 |
| 2C | 2250 | 7.2 | 6.97 | −.0080<br>−.0084 | 100.2 | 76.5 | 4 | 90/95 | 11 |

NOTE:
(1) In the shrinkage column − means growth, + means shrinkage
(2) The two values for shrinkage and hardness are based on (a) tensile bars and (b) impact bars

TABLE 2

| | Tensile Bars Hardness | | Impact Bars Hardness | |
|---|---|---|---|---|
| | 15 N | Rc | 15 N | Rc |
| Heat Treated<br>0.55 C, 1650° F., 90 min. | 88 | 49 | 87 | 40 |
| Drawn<br>400° F., 30 min. | 83 | 41 | 83 | 39 |
| Redrawn<br>350° F., 30 min. | 83 | 42 | 83 | 40 |
| UTS 104.5 ksi | Elong. | <.5% | Impact | 6 ft lbs |
| Microhardness (Rc) | 57 | 58 | 59 | 40/58 |
| Distance (ins.) | .002 | .004 | .006 | .009 |
| | 50 | 51 | 48 | 48 |
| | .013 | .019 | .022 | .025 |
| | 48 | 48 | 48 | 39 |
| | .030 | .037 | .047 | .057 |
| | 25 | | | |
| | .018 | | | |

TABLE 3

| Example | Tonnage (tsi) | Time/Temp (min/°F.) | Green Density (g/cc) | Sintered Density (g/cc) | Shrinkage (in/in) | Hardness ($R_B$) | UTS (ksi) | Yield (ksi) | El. (%) | Impact (ft-lbs) | E × $10^6$ |
|---|---|---|---|---|---|---|---|---|---|---|---|
| 3A | 50 | 30/2175 | — | — | −.0017 | 85 | 87.1 | 52.6 | 5 | 33 | 19 |
| B | 50 | 60/2175 | — | — | −.0014 | 83 | 91.4 | 59.3 | 5 | 31 | 21 |
| C | 30 | 90/2175 | 6.89 | 6.99 | +0.0016 | 74 | 71.8 | 44.4 | 5 | 76 | 16 |
| D | 45 | 90/2175 | 7.05 | 7.14 | +0.0006 | 80 | 81.1 | 48.6 | 5 | 24 | 28 |
| E | 50 | 90/2175 | 7.25 | 7.25 | +0.0002 | 84 | 87.6 | 52.3 | 5 | 38 | 20 |
| F | 60 | 90/2175 | 7.33 | 7.34 | −0.0003 | 88 | 90.7 | 52.8 | 7 | 38 | 20 |
| G | 50 | 90/2175 | + Annealed in $N_2$ | | −0.0001 | 67 | 62.3 | 35.9 | 10.7 | 49 | 18 |
| 4A | 50 | 30/2175 | — | — | −0.0008 | 81 | 82.5 | 50.4 | 5 | 31 | 19 |
| B | 50 | 60/2175 | — | — | −0.0004 | 82 | 83.3 | 56.7 | 5 | 31 | 20 |
| C | 30 | 90/2175 | 6.90 | 6.85 | +0.0014 | 73 | 71.9 | 47.0 | 4 | 14 | 21 |
| D | 40 | 90/2175 | 7.01 | 7.10 | +0.0011 | 82 | 82.8 | 52.7 | 4.5 | 25 | 20 |
| E | 50 | 90/2175 | 7.16 | 7.27 | +0.0001 | 84 | 90.4 | 56.2 | 5 | 33 | 21 |
| F | 60 | 90/2175 | 7.27 | 7.36 | −0.0006 | 87 | 93.6 | 62.6 | 5 | 40 | 22 |
| G | 50 | 90/2175 | + Annealed in $N_2$ | | −.0001 | 67 | 61.4 | 35.9 | 10 | 42 | 22 |

Note:
In the shrinkage column, − means growth and + means shrinkage.

TABLE 4

| Compacting Pressure (tsi) | Time Temperature (min/°F.) | Shrinkage* (In/In) | Hardness (Rb) | UTS (× $10^3$ psi) | Elongation (%) | Impact Strength (ft. lbs.) |
|---|---|---|---|---|---|---|
| 30 | 60/2100° F. | .0000 | 59 | 53.9 | 4.3 | 15.7 |
| 40 | 60/2100° F. | −.0005 | 70 | 66.2 | 5.3 | 23.8 |
| 50 | 60/2100° F. | −.0009 | 77 | 75.5 | 5.3 | 29.2 |

TABLE 4-continued

| Compacting Pressure (tsi) | Time Temperature (min/°F.) | Shrinkage* (In/In) | Hardness (Rb) | UTS ($\times 10^3$ psi) | Elongation (%) | Impact Strength (ft. lbs.) |
|---|---|---|---|---|---|---|
| 60 | 60/2100° F. | −.0006 | 78 | 73.6 | 5.7 | 36.8 |
| 30 | 60/2150° F. | .0000 | 60 | 42.1 | 4.0 | 14.7 |
| 40 | 60/2150° F. | −.0001 | 69 | 49.8 | 5.7 | 22.2 |
| 50 | 60/2150° F. | −.0005 | 75 | 54.6 | 6.6 | 33.2 |
| 60 | 60/2150° F. | −.0006 | 78 | 54.3 | 5.3 | 34.5 |
| 30 | 60/2200° F. | −.0011 | 80 | 74.1 | 3.7 | 13.6 |
| 40 | 60/2200° F. | −.0023 | 87 | 84.3 | 4.0 | 16.4 |
| 50 | 60/2200° F. | −.0030 | 89 | 89.4 | 4.3 | 19.6 |
| 60 | 60/2200° F. | −.0031 | 91 | 92.1 | 4.7 | 32.4 |
| 30 | 60/2150° F. | −.0003 | 51 | 46.8 | 5.0 | 15.0 |
| 40 | 60/2150° F. | −.0009 | 62 | 57.2 | 5.7 | 22.0 |
| 50 | 60/2150° F. | −.0009 | 67 | 62.3 | 6.7 | 33.2 |
| 60 | 60/2150° F. | −.0008 | 72 | 64.5 | 6.7 | 35.0 |
| 30 | 60/2150° F. | −.0015 | 65 | 61.2 | 4.3 | 16.2 |
| 40 | 60/2150° F. | −.0014 | 73 | 69.4 | 5.7 | 24.2 |
| 50 | 60/2150° F. | −.0006 | 80 | 74.0 | 5.7 | 32.6 |
| 60 | 60/2150° F. | −.0002 | 84 | 81.7 | 6.3 | 36.9 |

*− is growth and + is shrinkage

TABLE 5

| | density g/cc | | | | | | | Strength | | % |
|---|---|---|---|---|---|---|---|---|---|---|
| Example | Green | Sintered | % P | % Mo | % C | % Ni | % B | MPa | Ksi | Elongation |
| 6 | 7.33 | 7.34 | 0.1 | 3 | 0.1 | 2.4 | 0.20 | 750 | 109 | 3.8 |
| 7 | 7.27 | 7.20 | 0.1 | 3 | 0.1 | 2.4 | 0.25 | 804 | 117 | 2.03 |
| 8 | 7.24 | 7.35 | 0.1 | 3 | 0.1 | 4.0 | 0.20 | 761 | 110 | 4.9 |
| 9 | 7.32 | 7.25 | 0.1 | 3 | 0.1 | 4.0 | 0.25 | 100 | 116 | 3.2 |

We claim:

1. A powder metal composition consisting essentially of about from 1 to 4 wt % nickel, about from 2 to 4 wt % molybdenum, about from 0.1 to 0.3 wt % boron, about from 0.1% to 0.2 wt % carbon, about from 0.1 to 0.2 wt % phosphorus and the balance iron.

2. A powder metal composition of claim 1 wherein the combined weight of boron, carbon and phosphorus is less than about 0.5 wt %.

3. A powder metal composition of claim 2 consisting essentially of about 0.1% boron, 0.1% carbon, 0.1% phosphorus, 2% nickel, 3% molybdenum and the balance iron.

4. A powder metal composition of claim 1 having a particle size of about from 1 to 200 microns.

5. A process for forming a powder metal composition consisting essentially of about from 1 to 4% nickel, about from 2 to 4% molybdenum, about from 0.1 to 0.3% boron, about from 0.1% to 0.2% carbon, about from 0.1% to 0.2% phosphorous and the balance iron by blending the powder components, pressing the blend into the desired configuration at a pressure of about from 400 to 850 MPa, and sintering the resulting article in a partial vacuum, dry hydrogen or an inert atmosphere at a temperature of about from 1160° to 1200° C. for a period of about from 30 to 90 minutes.

6. A process of claim 5 wherein the resulting article is subsequently heat treated at a temperature of from from 800° to 1000° C. for a period of about from 1 to 2 hours.

7. A process of claim 5 wherein the article is sintered in dry hydrogen or a partial vacuum of about from 100 to 500 microns of mercury.

* * * * *